United States Patent [19]

Monma

[11] Patent Number: 4,462,682

[45] Date of Patent: Jul. 31, 1984

[54] ELECTROSTATIC RECORDING APPARATUS

[75] Inventor: Masao Monma, Hachioji, Japan

[73] Assignee: Konishiroku Photo Industry Co., Ltd., Tokyo, Japan

[21] Appl. No.: 237,602

[22] Filed: Feb. 24, 1981

[30] Foreign Application Priority Data

Feb. 27, 1980 [JP] Japan ..... 55-24255

[51] Int. Cl.[3] ..... G03G 21/00

[52] U.S. Cl. ..... 355/15; 355/1

[58] Field of Search ..... 355/1, 3 R, 15

[56] References Cited

U.S. PATENT DOCUMENTS 3,961,848 6/1976 Turner ..... 355/15 X 4,074,217 2/1978 Yanagawd ..... 355/1 X 4,277,160 7/1981 Yamada ..... 355/15 X

*Primary Examiner*—Fred L. Braun

*Attorney, Agent, or Firm*—Jordan B. Bierman; Linda Bierman; C. Cornell Remsen, Jr.

[57] ABSTRACT

In electrostatic recording apparatus recording head such as an optical fiber tube (OFT) is closely spaced from the image forming member, such as a drum covered with a photosensitive substance. The electrostatic latent image is generally formed with the use of a toner applied to the drum. Despite the use of various cleaning devices, toner particles are carried by the drum into the narrow gap between the OFT and the drum and adhere to the scanning face of the OFT, interfering with the projected image. The present invention provides a manual or automatic cleaning device positioned in the narrow gap for removing adherent toner or other interfering material from the scanning face of the OFT.

4 Claims, 8 Drawing Figures

ELECTROSTATIC RECORDING APPARATUS

BACKGROUND OF THE INVENTION

1. Field of the Invention

The present invention relates to an electrostatic recording apparatus and more particularly to an electrostatic recording apparatus wherein a cleaning member is arranged on a recording apparatus and in which an electrostatic latent image is formed on a moving image forming member with the use of an electrostatic recording head.

2. Description of the Prior Art

Heretofore, in recording apparatus in which an electrostatic latent image is formed on the image forming member (e.g. a photosensitive drum covered by the photosensitive substance for electrostatic recording) with the use of an electrostatic recording head (e.g. optical fiber tube (OFT) etc.), the electrostatic latent image formed on the image forming member is generally developed with the use of toner, and the resulting toner image is transferred to the transferrinng medium (e.g., an ordinary sheet of paper). Additionally, as an image forming member, one with the form of an endless belt covered by aforesaid photosensitive substance is used.

As a photosensitive substance, selenium, zinc oxide, cadmium sulfide and organic photoconductive material placed respectively on the electrically conductive support by an appropriate method are used, and as this photosensitive substance, not only photoconductive material but also a dielectric substance made of insulating material are used. The typical apparatus and its process will be described with the aid of FIG. 1. In FIG. 1, the numeral 1 is a photosensitive drum, and the photosensitive layer 2 for electrostatic recording is vaporized or is spread on the surface thereof. This photosensitive drum 1 rotates clockwise and the photosensitive layer 2 is evenly charged by the corona charger 3. In case the photosensitive layer 2 is selenium, it is charged positively by the charger 3. The photosensitive layer 2 thus charged passes the OFT scanning face 4 upon rotation of the photosensitive drum 1. The OFT scanning face 4 lies opposite the photosensitive layer 2 with a very narrow clearance of about 100–500 μm. The area on the photosensitive layer that receives the light from the OFT scanning face loses the charges on its surface and an electrostatic latent image is formed on the photosensitive layer. The photosensitive layer 2 having an electrostatic latent image thereon passes the developing device 5 upon rotation of the photosensitive drum 1. The toner is brought into contact with the electrostatic latent image, so that a toner image (a visible image) may be formed.

The recording sheet P fed at the same speed as the moving speed of the photosensitive layer 2, on the other hand, contacts the photosensitive layer 2 near the charger 6 for transferring, and after a toner image is formed on the photosensitive layer 2 is transferred onto the recording sheet P; the latter is detached from the drum 1 by the charger 7 and then is fed to the fixing device (not illustrated). The photosensitive layer 2 loses most of the adhering toner at the transferring step and a small amount of toner not transferred still remains thereon. The photosensitive layer 2 having this remaining toner thereon passes the neutralizer 8 upon further rotation of the photosensitive drum 1, thereby the remaining toner loses its electrostatic adhesive power and it is cleaned by passing the next cleaning device 9. The photosensitive layer 2 thus cleaned again passes the charger 3 thereunder to be evenly charged at its surface and at the OFT scanning face, the electrostatic recording is made and the above-mentioned cycle is repeated. In the cleaning device, a fur brush, a roller blade and a web etc. are put to practical use as a cleaning means. In case an OFT or the like is used as an electrostatic recording head, the OFT scanning face is opposed to the photosensitive layer with a very narrow clearance as stated before in order to obtain the clear image with no blur. Accordingly, even a small amount of toner tends to adhere electrostatically and physically when passing the OFT scanning face and even a small amount of remaining toner adheres and is accumulated on the OFT scanning face after using the apparatus for the long time, and therefore image information on the OFT scanning face becomes hard to be projected onto the surface of the photosensitive layer, and in the worst case it becomes impossible to be projected, resulting in an extreme disturbance of the aforesaid formation of the latent image. Therefore, on an electrostatic recording apparatus wherein an electrostatic recording head such as an OFT or the like is used, how to clean the head portion and how to keep it clean will be a big problem to be solved. The most sure way for the removal of the adhering toner is to wipe off the OFT scanning face directly and it has been the conventional way to wipe off the OFT scanning face after removing the OFT from the recording position, since the surface of the OFT scanning face is a ground glass. The photosensitive layer is damaged very easily and the clearance between the OFT scanning face and the photosensitive layer is very narrow as stated before. However, a complicated mechanism is needed for removing the OFT from the recording position and further it has drawbacks that a great effort is needed to keep the clearance between OFT and photosensitive layer constant with accuracy.

SUMMARY OF THE INVENTION

With a view to solve the aforementioned drawbacks in an electrostatic recording apparatus, it is an object of the present invention to propose an electrostatic recording aapparatus wherein a moving member that moves in parallel with a scanning face of an electrostatic recording head and a guide member that guides the moving member are arranged and a cleaning member that cleans the scanning face is arranged on the moving member.

BRIEF DESCRIPTION OF THE DRAWINGS

FIGS. 2A and 2B show the type wherein a wiping off member moves in parallel with the OFT scanning direction and FIGS. 4A and 4B show the example wherein a wiping off member moves perpendicular to the OFT scanning direction.

DETAILED DESCRIPTION OF THE PREFERRED EMBODIMENTS

Figure 1:
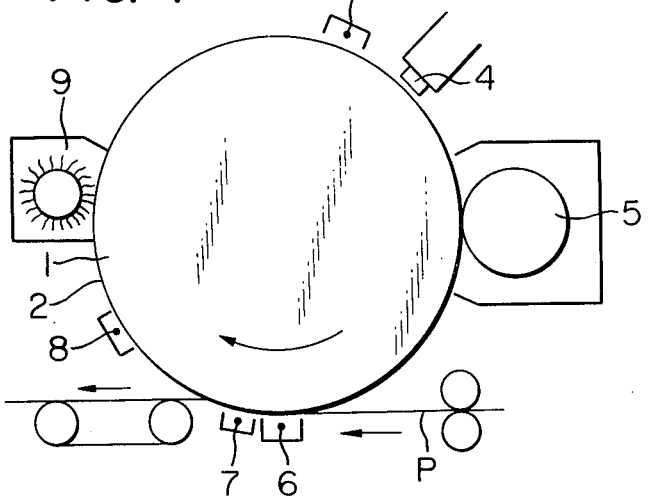
FIG. 1 PRIOR ART
FIG. 1 is a structural diagram of a typical electrostatic recording apparatus and FIGS. 2A and 2B and 4A and 4B are structural diagrams of the cleaning device of the present invention.
Figure 2A:
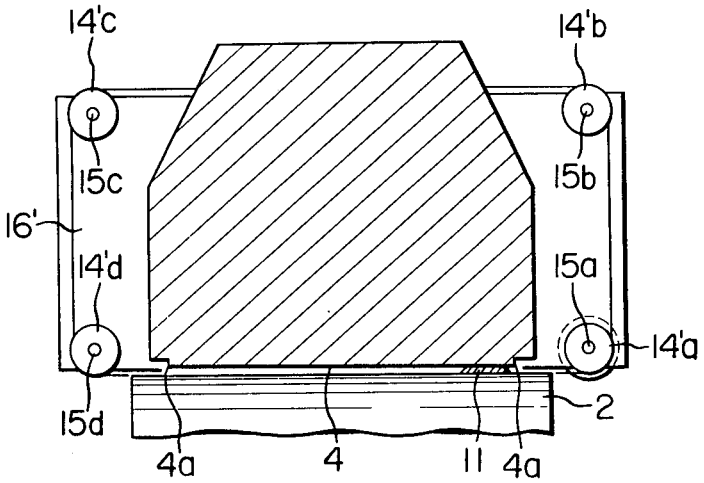
Figure 2B:
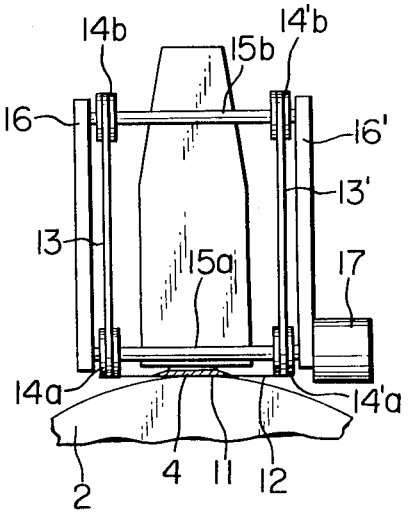
Figure 3:
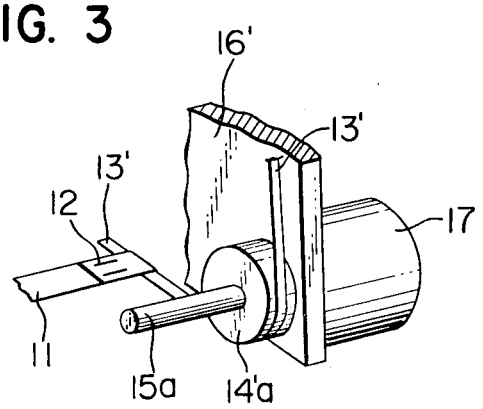
FIG. 3 is an enlarged perspective view of a detail of the device of FIGS. 2A and 2B.

An example of the present invention will be diagrammatically illustrated. FIGS. 2A and 2B show an example wherein a cleaning member moves in parallel with an OFT scanning direction (or parallel to the direction of the axis of photosensitive substance drum), FIG. 2A is a cross-sectional view viewed in parallel with the axis of photosensitive substance drum, FIG. 2B is a side view viewed at a right angle to the axis of photosensitive substance drum and FIG. 3 is a perspective view wherein the pulleys and adjacent parts are enlarged. In these drawings, 2 is a photosensitive layer and 4 is the scanning face of an OFT to effect an exposure of signals to be recorded. The numeral 11 is a soft cleaning member to clean the OFT scanning face, 12 is an extension to hold the cleaning member 11 on a carrier in the form of belts 13 and 13'. Belts 13 and 13' are located before and behind the OFT respectively and they extend over pulleys 14*a*, 14*b*, 14*c* and 14*d* and pulleys 14'*a*, 14'*b*, 14'*c* and 14'*d* respectively to guide the aforesaid extension 12. Pulleys 14*a* and 14*a'*, pulleys 14*b* and 14*b'*, pulleys 14*c* and 14*c'* and pulleys 14*d* and 14*d'* are respectively supported by the shafts 15*a*, 15*b*, 15*c* and 15*d* are interposed between supporting members 16 and 16' fixed to the electrostatic recording apparatus. Namely, the cleaning member 11 is so constructed that it can be guided into the narrow clearance between the OFT scanning face 4 and the photosensitive layer 2. The shaft 15*a* is connected to the power source 17 such as a motor or a rotary solenoid, etc.

The operation of the apparatus thus constructed will be explained next. Cleaning member 11 whose two ends are attached to the extensions 12 to the two belts 13 and 13' arranged before and behind the OFT substantially in parallel with the scanning direction of the OFT, is arranged at right angles to the scanning direction of the OFT, and is moved by the power source 17 between the scanning face 4 of the OFT and the photosensitive layer 2. As stated before, since the clearance between the OFT scanning face 4 and the photosensitive layer 2 is around 500 μm, the cleaning member 11 should have sufficient flexibility to become smaller than said clearance when compressed. Material that does not injure the opposing members when rubbed against the OFT scanning face and the photosensitive layer is appropriate for the cleaning member 11; good results are obtained from a fibrous material such as cotton, wool, felt and non-woven cloth or from a spongy material etc. In order that the cleaning member 11 may enter smoothly into said clearance, it is desirable that the left and right edges 4*a* of the OFT scanning face that are the entrances of the clearance are properly chamfered, or chamfered members are attached thereto. Belts 13 and 13' may be a wire or a chain etc. The present apparatus may be the one wherein the power source 17 is driven periodically by the sequence control circuit every several copies or several tens of copies, or one wherein the power source 17 is manually turned on when a signal to detect the contamination on the OFT scanning face is generated, thus cleaning as the occasion warrants.

Figure 4A:
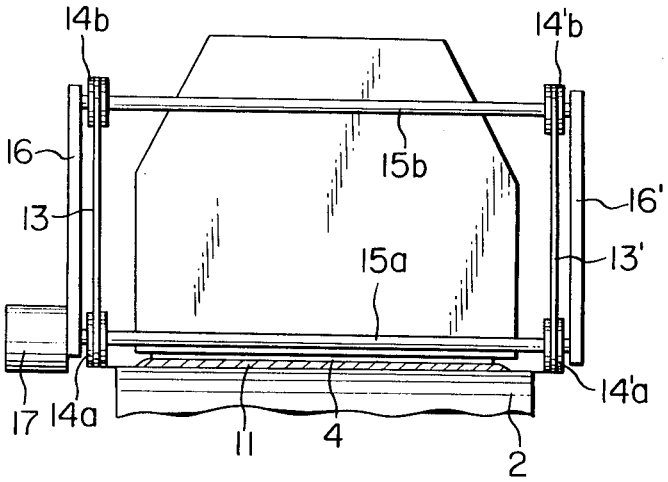
Figure 4B:
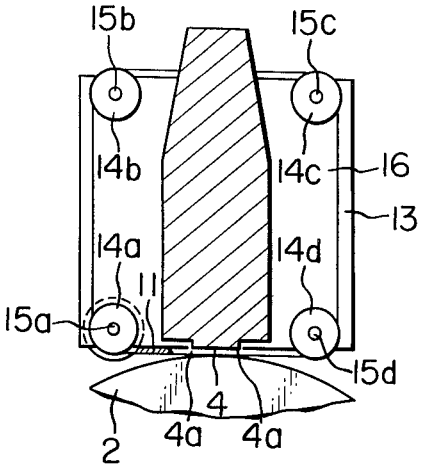

FIGS. 4A and 4B show another example in which the cleaning member moves in a direction perpendicular to an OFT scanning direction (or the direction of the axis of photosensitive substance drum). FIG. 4A is a side view viewed in parallel with the axis of photosensitive substance drum, while FIG. 4B is a cross-sectional view viewed at a right angle to the axis of photosensitive substance drum.

All the members with numeral and operation of them are same as those in FIG. 2 except for that the cleaning member to clean an OFT scanning face moves in a direction perpendicular to an OFT scanning direction.

In this example since the cleaning member moves in a direction perpendicular to an OFT scanning direction, it takes less time to clean the OFT scanning face than the time to clean it in the way as shown in last example. On the other hand, in this example the cleaning member 11 meets much more resistance to enter the clearance between the OFT scanning face 4 and the photosensitive layer 2. It is possible to clean the face by moving the cleaning member 11 through the clearance from one side to other side. And it is also possible to clean the face by once entering the cleaning member 11 and then returning the cleaning member.

Figure 5:
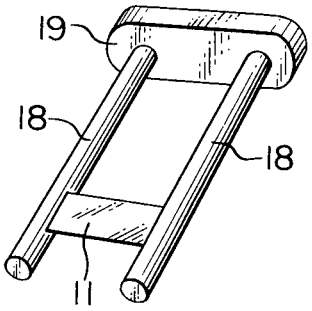
FIG. 5 is a perspective view of a manual cleaning device and FIG. 6 is a diagrammatic cross-sectional view of the apparatus shown in aforesaid FIG. 5, and its relationship to the OFT.
Figure 6:
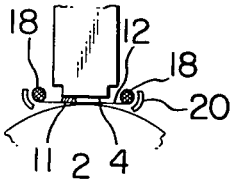

FIG. 5 is a perspective view of another example of the invention that is the cleaning device in a manual mode and FIG. 6 is a cross-sectional view of the apparatus shown in the FIG. 5. In the apparatus according to this example the cleaning member 11 is fixed between two parallel bars 18 (moving members). And a grip 19 is attached at the end of the bars. The numeral 20 shows guide rails (guide members) to guide the parallel bars 18. The guide rails 20 are arranged in parallel to the OFT scanning direction of the electrostatic recording apparatus. By setting the bars 18 on the guide rails 20 and pushing the grip 19, the cleaning member 11 enters the clearance between the OFT scanning face 4 and photosensitive layer 2.

In this manual cleaning device, when a signal (which may be obtained by measuring the reflection of the light from a toner image of a mark that is recorded on the photosensitive layer by the OFT after developing a mark on the developing device; the mark is recorded in advance of giving an exposure of recording signals) to detect the contamination of the OFT scanning face is generated, or at the time of periodic inspection, the cleaning member 11 can be easily moved with its simple structure.

As mentioned above the present invention proposes an electrostatic recording apparatus wherein a moving member that moves in parallel with a scanning face of an electrostatic recording head and a guide member that guides the moving member are arranged, and a cleaning member that cleans the scanning face is arranged on the moving member. According to the present invention it is possible to guide the cleaning member between the electrostatic recording head and photosensitive layer without injuring them. It is also possible to arrange compactly the moving members and aforesaid guiding member in the space around the electrostatic recording head and therefore it is possible to easily incorporate it in the apparatus of this kind. A large scale mechanism to move the electrostatic recording head itself or the stand wherein the electrostatic recording head is incorporated, is therefore unnecessary.

Further, with the present invention, it is possible to clean the scanning face of the electrostatic recording head without changing the clearance between the electrostatic recording head and the photosensitive layer and thereby the recording capability of the electrostatic recording head can promptly be restored, which causes the rate of operation of the recording apparatus to be enhanced.

What is claimed is:

1. In an electrostatic recording apparatus of the type in which a latent image is formed on an image forming member by the use of a closely spaced electrostatic recording head having a scanning face opposite the image forming member, the improvement comprising a carrier in the form of a pair of endless belts, one mounted on each side of said recording head and intermediate said image forming member and the scanning face of said electrostatic recording head, pulleys supporting said endless belts parallel to said scanning face and spaced from and movable with respect to both said image forming member and said scanning face, and cleaning means comprising compressible material of a thickness normally greater than the space between the scanning face of said electrostatic recording head and said image forming member, mounted on and between said pair of endless belts and in contact with said scanning face, whereby rubbing contact of said compressible material with said scanning face is assured and undesirable material accumulating on said scanning face is wiped off by said compressible material, and in which the edge of the scanning face of said electrostatic recording head is formed with cut-out sections adapted to receive said cleaning means.

2. In an electrostatic recording apparatus, the improvement according to claim 1, in combination with means driving said endless belts.

3. In an electrostatic recording apparatus, the improvement according to claim 2 in which said endless belts move in a direction parallel to the scanning direction of said electrostatic recording head.

4. In an electrostatic recording apparatus, the improvement according to claim 2, in which said endless belts move in a direction perpendicular to the scanning direction of said electrostatic recording head.

* * * * *